US009717939B2

(12) United States Patent
Wei et al.

(10) Patent No.: US 9,717,939 B2
(45) Date of Patent: Aug. 1, 2017

(54) FIRE EXTINGUISHING COMPOSITION CONTAINING TRANSITION METAL COMPOUND

(75) Inventors: Tao Wei, Xi'an (CN); Tao Ji, Xi'an (CN); Shengxin Liu, Xi'an (CN)

(73) Assignee: XI'AN WESTPEACE FIRE TECHNOLOGY CO., LTD, Shaanxi (CN)

( * ) Notice: Subject to any disclaimer, the term of this patent is extended or adjusted under 35 U.S.C. 154(b) by 0 days.

(21) Appl. No.: 14/374,837

(22) PCT Filed: Aug. 16, 2012

(86) PCT No.: PCT/CN2012/080266
§ 371 (c)(1),
(2), (4) Date: Jul. 25, 2014

(87) PCT Pub. No.: WO2013/071782
PCT Pub. Date: May 23, 2013

(65) Prior Publication Data

US 2015/0190664 A1 Jul. 9, 2015

(30) Foreign Application Priority Data

Nov. 20, 2011 (CN) ..... 2011 1 0451465

(51) Int. Cl.
*A62D 1/06* (2006.01)

(52) U.S. Cl.
CPC ..... *A62D 1/06* (2013.01)

(58) Field of Classification Search
None
See application file for complete search history.

(56) References Cited

U.S. PATENT DOCUMENTS

| | | | | |
|---|---|---|---|---|
| 4,194,979 | A | 3/1980 | Gottschall | |
| 5,800,830 | A | 9/1998 | Asano et al. | |
| 6,217,788 | B1 * | 4/2001 | Wucherer et al. | 252/5 |
| 6,780,991 | B2 * | 8/2004 | Vandersall et al. | 536/114 |
| 2003/0038272 | A1 | 2/2003 | Figiel et al. | |
| 2004/0020502 | A1 | 2/2004 | Tosas et al. | |
| 2006/0217469 | A1 | 9/2006 | Bauer et al. | |
| 2010/0093882 | A1 | 4/2010 | Ohama | |
| 2010/0329960 | A1 * | 12/2010 | Blanchard | C06B 43/00 423/351 |
| 2011/0089087 | A1 | 4/2011 | Politi et al. | |
| 2013/0181158 | A1 * | 7/2013 | Guo et al. | 252/2 |

FOREIGN PATENT DOCUMENTS

| | | | | |
|---|---|---|---|---|
| CA | 2772639 | A1 * | | 7/2011 |
| CN | 101757760 | A | | 6/2010 |
| CN | 101810919 | A | | 8/2010 |
| CN | 101862517 | A | | 10/2010 |
| CN | 102179024 | A | | 9/2011 |
| CN | 102179026 | A | | 9/2011 |
| EP | 1416032 | A1 | | 5/2004 |
| FR | 2244052 | | * | 4/1975 |
| JP | 53-19697 | A | | 2/1978 |
| JP | 58-112565 | A | | 7/1983 |
| JP | 61-197659 | A | | 9/1986 |
| JP | 2004-154165 | A | | 6/2004 |
| RU | 2091106 | C1 * | | 9/1997 |
| SU | 1819644 | | * | 6/1993 |
| WO | WO 2012034494 | A1 * | | 3/2012 |

OTHER PUBLICATIONS

International Preliminary Report on Patentability issued May 20, 2014; ref: PCT/CN2012/080267; 6 pages; citing: CN101862517A and CN101810919A.
International Search Report issued Nov. 22, 2012; re: PCT/CN2012/080267; citing: CN 101862517 A, CN 101810919 A, JP 53-19697 A, EP 1416032 A1, JP 2004-154165 A and US 2003/0038272 A1.
Written Opinion issued Nov. 22, 2012 re: PCT/CN2012/080267; 5 pages; citing: CN101862517A and CN101810919A.
Internationa Preliminary Report on Patentability issued May 20, 2014 re: PCT/CN2012/080266; 8 pages; citing: CN101757760A and CN102179024A.
International Search Report issued Nov. 22, 2012; re: PCT/CN2012/080266; 3 pages; citing: CN 101757760 A, CN 102179024 A, CN 102179026 A, JP 58-112565 A and JP 61-197659 A.
Written Opinion issued Nov. 22, 2012 re: PCT/CN2012/080266; 7 pages; citing: CN101757760A and CN102179024A.

* cited by examiner

*Primary Examiner* — Tanisha Diggs
(74) *Attorney, Agent, or Firm* — Cantor Colburn LLP

(57) ABSTRACT

The disclosure relates to a fire extinguishing composition containing a transition metal compound, comprising a salt of an organic acid of the fourth period elements in a subgroup and the group VIII; and using a pyrotechnic agent as a heat source and a power source, reacting through heat emitted by igniting the pyrotechnic agent to burn and outputting a fire extinguishing material. In the disclosure, a transition metal compound is selected as a primary ingredient, then an amine and/or organic amine salt is added to assist in fire extinguishing, a fire extinguishing aerosol is formed by using the fire extinguishing material generated by heating and decomposing the transition metal compound, and meanwhile the amine and/or organic amine salt is heated and decomposed to generate a great quantity of gas, thereby increasing the concentration and the air pressure strength of the fire extinguishing aerosol, improving the injection strength of the fire extinguishing material, and greatly improving the fire extinguishing performance of the fire extinguishing composition.

5 Claims, No Drawings

FIRE EXTINGUISHING COMPOSITION CONTAINING TRANSITION METAL COMPOUND

TECHNICAL FIELD

The disclosure relates to the technical field of fire prevention and extinguishment, and more particularly to an aerosol fire extinguishing agent containing a transition metal compound.

BACKGROUND

Aerosol fire extinguishing agent, which is a novel non-toxic harmless fire extinguishing agent with high fire extinguishing efficiency, zero Ozone Depletion Potential (ODP), extremely low residues and little equipment investment, is strongly supported by the government and meets market demands under the urgent background of Halon elimination. Therefore, aerosol fire extinguishing technology has become one of the noticeable alternative technologies of Halon in the past dozen years.

Major fire extinguishing mechanisms of aerosol generator are as follows: 1. heat absorption and cooling; 2. chemical inhibition; 3. smothering; 4. isolation; chemical inhibition is the primary mechanism. Although the aerosol generator is obviously advantageous in aspects including fire extinguishing efficiency, storage conditions, engineering cost, maintenance management, toxicity, secondary damage, environment protection and fire extinguishing concentration etc. Oxidation-reduction reactions of the aerosol generator releases a great quantity of gas and active particles while releasing a great deal of heat to bring disadvantages in usage. A cooling system of a fire extinguishing apparatus needs to be improved in order to cool the equipment and the aerosol to avoid a secondary fire. Conventional physical cooling results in a complex and heavy equipment structure, complicated processes and high cost. Physical cooling deactivates a great quantity of active particles, thus greatly reducing the fire extinguishing performance. In addition, the fire extinguishing efficiency is limited, thus causing waste of agent cost to a certain extent. If a chemical cooling method is applied, a coolant is generally placed in a spraying direction of a pyrotechnic fire extinguishing agent. However, a common chemical coolant will affect the fire extinguishing efficiency of the pyrotechnic fire extinguishing agent. Currently, selection of the fire extinguishing composition are still being studied and researched constantly, and the fire extinguishing efficiency of a commercial fire extinguishing agent is not ideal. The stability and spraying intensity of the fire extinguishing composition, considered as a whole, should realize inhibition of flames and rapid and effective inhibition of a fire source.

SUMMARY

In order to overcome disadvantages still existing in the fire extinguishing efficiency and chemical stability of a fire extinguishing composition in the prior art, the disclosure provides a fire extinguishing composition containing a transition metal compound.

The technical solution to solve the technical problem is as follows:

a fire extinguishing composition containing a transition metal compound, including a salt of an organic acid of the fourth period elements of transition metals in a subgroup and the group VIII; and the fire extinguishing composition adopts a pyrotechnic agent as a heat source and a power source, reacts and releases a fire extinguishing material through heat emitted by igniting and burning the pyrotechnic agent.

Further, the mass percentage of the salt of the organic acid is 65 wt % to 95 wt %.

Further, the salt of the organic acid of the fourth period transition metals in the subgroup is a salt of an organic acid of a transition metal element in the group IB, the group IIB or the group VIIB.

Further, the salt of the organic acid of the fourth period transition metals in the subgroup and group VIII is a ferric salt of an organic acid, a manganese salt of an organic acid, a nickel salt of an organic acid, a copper salt of an organic acid, a zinc salt of an organic acid or a cobalt salt of an organic acid.

Further, the ferric salt of the organic acid is one or more of ferric citrate, ferric oxalate, ferric oleate, ferric linoleate, ferric stearate, ferric benzoate, ferric acetate, ferric salicylate and ferric gluconate.

Further, the manganese salt of the organic acid is one or more of manganous acetate, manganese oxalate, manganese citrate, manganous benzoate, manganese salicylate and manganese gluconate.

Further, the nickel salt of the organic acid is one or more of nickel acetate, nickel oxalate, nickel oleate, nickel citrate, nickel benzoate, nickel salicylate and nickel aminosulfonate.

Further, the copper salt of the organic acid is one or more of copper acetate, copper formate, copper oxalate, copper oleate, copper linoleate, copper stearate, copper citrate, copper tartrate, copper 2-hydroxybutanedioate, copper iso-octoate, copper benzoate, and copper salicylate.

Further, the zinc salt of the organic acid is one or more of zinc acetate, zinc oxalate, zinc oleate, zinc stearate, zinc citrate, zinc benzoate, zinc methacrylate, zinc salicylate and zinc gluconate.

Further, the cobalt salt of the organic acid is one or more of cobalt acetate, cobalt oxalate, cobalt citrate, cobalt citrate, cobalt iso-octoate, cobalt benzoate, cobalt salicylate and cobalt amino-sulfonate.

Further, the fire extinguishing composition further includes an auxiliary fire extinguishing agent in a mass percentage of 5 wt % to 35 wt %.

Further, the auxiliary fire extinguishing agent is an amine and/or organic amine salt.

Further, the organic amine salt includes an organic amine hydrochloride and an organic amine sulfate.

Further, the organic amine hydrochloride is one or more of 2-methylaniline hydrochloride, 3,3'-dimethylbenzidine dihydrochloride, N'N-di methyl-p-phenylenediamine sulphate, N,N'-dimethyl-p-phenylenediamine monohydrochloride, N'N-diethyl-p-phenylenediamine sulphate, N,N'-diethyl-p-phenylenediamine monohydrochloride, 1-naphthylamine hydrochloride, aniline hydrochloride, 3-hydroxyphenylamine hydrochloride, diphenylamine hydrochloride, dimethylamine hydrochloride, diethylamine hydrochloride, cyclohexylamine hydrochloride, benzidine sulfate, benzidine hydrochloride, trimethylamine hydrochlorate, triethylamine hydrochlorate, ethylenediamine hydrochloride, m-phenylenediamine hydrochloride, o-phenylendiamine hydrochloride, o-bromoaniline hydrochloride, N-(1-naphthyl)ethylenediamine hydrochloride and triethanolamine hydrochloride.

Further, the organic amine sulfate is one or more of m-phenylenediamine sulfate, hydroxylamine sulfate, o-phenylenediamine sulfate, 3-hydroxyphenylamine sulfate, ethylenediamine sulfate and diethylamine sulfate.

Further, the amine is one or more of o-nitroaniline, methacrylamide, salicylanilide, p-toluenesulfonamide, p-phenetidine, N-hydroxymethyl benzene sulfonamide, phthalimide and N,N'-methylenebisacrylamide.

The fire extinguishing composition of the disclosure further includes a performance additive; the performance additive is hydroxy propyl methyl cellulose, magnesium stearate, talc or a combination thereof; the mass percentage of the performance additive ranging from not larger than 0 to smaller than or equal to 15%.

Further, in the fire extinguishing composition:

the salt of the organic acid of the fourth period transition metals: 75 wt % to 90 wt %;

auxiliary fire extinguishing agent: 5 wt % to 20 wt %;

performance additive: 5 wt %.

The fire extinguishing mechanism of the fire extinguishing composition of the disclosure is as follows:

the salt of the organic acid of the transition metal in the fire extinguishing composition of the disclosure can decompose at high temperature to release active metal particle which can react with O., OH., H. free radicals generated by combustion reaction, so as to cut off the combustion reaction chain; at the same time, the fire is extinguished jointly by the physical cooling effect of aerosol grains and the chemical inhibitory effect of the aerosol itself; at the same time, the auxiliary fire extinguishing agent can release a large quantity of gas to increase the gas pressure of the aerosol, the gas is generally $N_2$ and $CO_2$; these gases can smother flames, have synergistic effect with the pyrotechnic agent and be together sprayed rapidly to reach the fire source to extinguish the fire, thus further improving the fire extinguishing efficacy of the fire extinguishing agent and greatly shortening the effective fire extinguishing time.

The fire extinguishing composition containing transition metal compound of the disclosure mainly has the following beneficial effect:

1. the disclosure uses the salt of the organic acid of the fourth period elements in the subgroup and the group VIII; since the transition metal element shows higher activity, more easily captures free radicals in combustion reaction, cuts off the reaction chain rapidly, realizes a better fire extinguishing effect; a great quantity of fire extinguishing material is generated by heating and decomposing the transition metal element to absorb heat to reduce the equipment temperature and the temperature of a generated aerosol on one hand, and to be sprayed with an aerosol generator, i.e. a pyrotechnic agent, to extinguish a fire on the other hand;

2. the amine and/or the organic amine salt of the disclosure are/is heated to decompose to generate a large quantity of $N_2$ and $CO_2$ gases, which can regulate the concentration and pressure intensity of the fire extinguishing aerosol and improve the spraying intensity of the fire extinguishing material; at the same time, the $N_2$ and $CO_2$ gases can extinguish the fire through smothering, and act with the salt of the organic acid of the transition metal to greatly improve the fire extinguishing efficacy of the fire extinguishing composition;

3. the proportions of fire extinguishing composition of the disclosure is optimize, the ingredients are fully reacted to avoid residues from blocking a nozzle of the fire extinguishing apparatus, and each ingredient is effectively utilized, thus, the effective utilization of the fire extinguishing composition is greatly improved;

4. the salts of the organic acids of the transition metal applied by the disclosure is stable in chemical properties, not easy to volatilize, can hardly react with each other and can be stored for a long period of time.

DETAILED DESCRIPTION OF THE EMBODIMENTS

A fire extinguishing composition of the disclosure will be further described in combination with specific examples below:

the fire extinguishing composition includes a salt of an organic acid of the fourth period transition metal elements in a subgroup and the group VIII, adopts a pyrotechnic agent as a heat source and a power source, reacts and releases a fire extinguishing material in use of heat emitted by igniting and burning the pyrotechnic agent. Wherein the salt of the organic acid in the subgroup mainly involves a salt of an organic acid of a transition metal element in the group IB, the group IIB or the group VIIB. The salt of the organic acid of the fourth period transition metal elements in the subgroup and the group VIII mainly includes one or more of a ferric salt of an organic acid, a manganese salt of an organic acid, a nickel salt of an organic acid, a copper salt of an organic acid, a zinc salt of an organic acid and a cobalt salt of an organic acid. The ferric salt of the organic acid is ferric citrate, ferric oxalate, ferric oleate, ferric linoleate, ferric stearate, ferric benzoate, ferric acetate, ferric salicylate or ferric gluconate etc.; the manganese salt of the organic acid is manganous acetate, manganese oxalate, manganese citrate, manganous benzoate, manganese salicylate or manganese gluconate etc.; the nickel salt of the organic acid is nickel acetate, nickel oxalate, nickel oleate, nickel citrate, nickel benzoate, nickel salicylate or nickel aminosulfonate etc.; the copper salt of the organic acid is copper acetate, copper formate, copper oxalate, copper oleate, copper linoleate, copper stearate, copper citrate, copper tartrate, copper 2-hydroxybutanedioate, copper iso-octoate, copper benzoate, or copper salicylate etc.; the zinc salt of the organic acid is zinc acetate, zinc oxalate, zinc oleate, zinc stearate, zinc citrate, zinc benzoate, zinc methacrylate, zinc salicylate or zinc gluconate etc.; the cobalt salt of the organic acid is cobalt acetate, cobalt oxalate, cobalt citrate, cobalt iso-octoate, cobalt benzoate, cobalt salicylate or cobalt amino-sulfonate etc.

An auxiliary fire extinguishing agent may be further added, i.e. an amine and/or organic amine salt. Wherein the organic amine salt includes an organic amine hydrochloride and an organic amine sulfate; the organic amine hydrochloride may be one or more of 2-methylaniline hydrochloride, 3,3'-dimethylbenzidine dihydrochloride, N'N-dimethyl-p-phenylenediamine sulphate, N,N'-dimethyl-p-phenylenediamine monohydrochloride, N'N-diethyl-p-phenylenediamine sulphate, N,N'-diethyl-p-phenylenediamine monohydrochloride, 1-naphthylamine hydrochloride, aniline hydrochloride, 3-hydroxyphenylamine hydrochloride, diphenylamine hydrochloride, dimethylamine hydrochloride, diethylamine hydrochloride, cyclohexylamine hydrochloride, benzidine sulfate, benzidine hydrochloride, trimethylamine hydrochlorate, triethylamine hydrochlorate, ethylenediamine hydrochloride, m-phenylenediamine hydrochloride, o-phenylendiamine hydrochloride, o-bromoaniline hydrochloride, N-(1-naphthylethyl)enediamine hydrochloride and triethanolamine hydrochloride. The organic amine sulfate may be one or more of m-phenylenediamine sulfate, hydroxylamine sulfate, o-phenylenediamine sulfate, 3-hydroxyphenylamine sulfate, ethylenediamine sulfate and diethylamine sulfate. The amine may be one or more of o-nitroaniline, methacrylamide, salicylanilide, p-toluenesulfonamide, p-phenetidine, N-hydroxymethylbenzene sulfonamide, phthalimide and N,N'-methylenebisacrylamide.

In order to facilitate processing or production, a performance additive and an adhesive may be further added, and prepared according to specific ingredients.

The materials above were used for preparing fire extinguishing compositions and tests were carried out, and fire extinguishing experiments were carried out together with a commercially available K-type aerosol fire extinguishing agent in the same conditions, specifically as follows:

Example 1

In the present example, 75 wt % of ferric oxalate and 20 wt % of diethylamine hydrochloride were applied as a coolant, 2.5 wt % of hydroxy methyl propyl cellulose was added as an adhesive, industrial alcohol was applied as a solvent, after pelleting with a 20-mesh sieve, 2.5% of magnesium stearate was added as a release agent, all the above materials were mixed uniformly and then passed through a 15-mesh sieve, and shaped into a honeycomb shape by using processes including pelleting, mould pressing and extruding etc. and loaded to a fire extinguishing apparatus.

Example 2

In the present example, 95 wt % of ferric oxalate was applied and 2.5 wt % of hydroxy methyl propyl cellulose was applied as an adhesive, and other coating processing etc. was the same as that in the first example.

Example 3

In the present example, 85 wt % of nickel citrate and 10 wt % of triethylamine hydrochlorate were applied, and other coating processing etc. was the same as that in the first example.

Example 4

In the present example, 95 wt % of nickel citrate was applied as a coolant, 2.5 wt % of hydroxymethyl propyl cellulose was added as an adhesive, industrial alcohol was used as a solvent, after pelleting with a 20-mesh sieve, 2.5 wt % of magnesium stearate was added as a release agent, all the above materials were mixed uniformly and then passed through a 15-mesh sieve, and shaped into a bar shape by using processes including pelleting, mould pressing and extruding etc. and loaded to a fire extinguishing apparatus.

Example 5

The major difference from the first example is that 65 wt % of cobalt salicylate and 20 wt % of cobalt acetate were used and diethylamine hydrochloride in a mass percentage of 10% was used as an auxiliary fire extinguishing agent; other adhesive, release agent, content thereof and composition preparation etc. were the same as the first example.

Example 6

In the present example, 65 wt % of cobalt salicylate and 30 wt % of cobalt acetate were used, 2.5 wt % of hydroxy methyl propyl cellulose was added as an adhesive, industrial alcohol was used as a solvent, after pelleting with a 20-mesh sieve, 2.5 wt % of magnesium stearate was added as a release agent, all the above materials were mixed uniformly and then passed through a 15-mesh sieve, and shaped into a tablet shape by using processes including pelleting, mould pressing and extruding etc. and loaded to a fire extinguishing apparatus.

After preparing and shaping 50 g of the fire extinguishing compositions of the first example to the sixth example in tests, the fire extinguishing compositions were loaded to a fire extinguishing apparatus containing 50 g of a K-type aerosol generator, and 8B fire extinguishing tests were carried out on 3 fires in each group; specific test methods, test models and evaluation methods are as follows, and results are recorded in Table 1:

test model: the oil disk is a GA86-2009 8B circular disk (diameter 570 mm, internal depth 150 mm and approximate area 0.25 $m^2$);

test method: 500 mm of water was added to the oil disk, then 2 mm of 93# gasoline was added, the oil disk was pre-burning for 1 min and then began fire extinguishment;

evaluation standard: it is considered that fire extinguishment is successful if there is no after-combustion 1 min after flame extinction and there is still gasoline remaining in the oil disk.

Comparison Experiment 1

A fire extinguishing test was performed for a fire extinguishing apparatus sample containing 100 g of a commercially available K-type hot aerosol fire extinguishing agent according to the same experiment model and experiment method as those in the examples above, and test results are as shown in Table 1.

TABLE 1

Test records of fire extinguishing compositions containing a salt of an organic acid of elements of group VIII

| | Ingredient content of examples (mass percentage) | | | | | | Comparison |
|---|---|---|---|---|---|---|---|
| Ingredient | 1 | 2 | 3 | 4 | 5 | 6 | 1 |
| K type agent | • | • | • | • | • | • | • |
| Ferric oxalate | 75 | 95 | | | — | — | |
| Cobalt salicylate | | | | | 65 | 65 | |
| Cobalt acetate | | | | | 20 | 30 | |
| Nickel citrate | | | 85 | 95 | | | |
| Diethylamine hydrochloride | 20 | | | | 10 | | |
| Triethylamine hydrochloride | | | 10 | | | | |
| Hydroxy methyl propyl cellulose | 2.5 | 2.5 | 2.5 | 2.5 | 2.5 | 2.5 | |
| Magnesium stearate | 2.5 | 2.5 | 2.5 | 2.5 | 2.5 | 2.5 | |

TABLE 1-continued

Test records of fire extinguishing compositions containing a salt of an organic acid of elements of group VIII

| | Ingredient content of examples (mass percentage) | | | | | | Comparison |
|---|---|---|---|---|---|---|---|
| Ingredient | 1 | 2 | 3 | 4 | 5 | 6 | 1 |
| Fire extinguishing time(s) | 6.2 | 7.0 | 6.0 | 6.0 | 6.0 | 6.2 | |
| Fire extinguishing situation | 2 extinguished in 3 | 1 extinguished in 3 | 2 extinguished in 3 | 1 extinguished in 3 | All extinguished | 1 extinguished in 3 | Not extinguished |

It can be clearly seen from Table 1 that the fire extinguishing compositions containing a salt of an organic acid of the fourth period transition metals in group VIII can meet basic fire extinguishing requirements of national standard GA86-2009 and there are no naked flames at all nozzles; the fire extinguishing performance is obviously better than that of the first comparison example and the fire extinguishing time is short.

Example 7

In the present example, 90 wt % of manganese acetate, 5 wt % of methacrylamide and 2.5 wt % of hydroxy methyl propyl cellulose were mixed, industrial alcohol was used as a solvent, after pelleting with a 20-mesh sieve, 2.5 wt % of magnesium stearate was added as a release agent, all the above materials were mixed uniformly and then passed through a 15-mesh sieve, and shaped into a ball shape by using processes including pelleting, mould pressing and extruding etc. and loaded to a fire extinguishing apparatus containing 50 g of a K-type hot aerosol generator, a 93# gasoline fire extinguishing test of an oil disk having an area of 0.25 $m^2$ was carried out; test results are as shown in Table 2 of test records.

Example 8

In the present example, 95 wt % of manganese acetate and 2.5 wt % of hydroxy methyl propyl cellulose were mixed, industrial alcohol was used as a solvent, after pelleting with a 20-mesh sieve, 2.5 wt % of magnesium stearate was added as a release agent, all the above materials were mixed uniformly and then passed through a 15-mesh sieve, and shaped into a ball shape by using processes including pelleting, mould pressing and extruding etc. and loaded to a fire extinguishing apparatus containing 50 g of a K-type hot aerosol generator, a 93# gasoline fire extinguishing test of an oil disk having an area of 0.25 $m^2$ was carried out; test results are as shown in Table 2 of test records.

Example 9

In the present example, 78 wt % of copper tartrate, 17 wt % of N,N'-methylenebisacrylamide and 2.5 wt % of hydroxy methyl propyl cellulose were mixed, industrial alcohol was used as a solvent, after pelleting with a 20-mesh sieve, 2.5 wt % of magnesium stearate was added as a release agent, all the above materials were mixed uniformly and then passed through a 15-mesh sieve, and shaped into a ball shape by using processes including pelleting, mould pressing and extruding etc. and loaded to a fire extinguishing apparatus containing 50 g of a K-type hot aerosol generator, a 93# gasoline fire extinguishing test of an oil disk having an area of 0.25 $m^2$ was carried out; test results are as shown in Table 2 of test records.

Example 10

In the present example, 95 wt % of copper tartrate, and 2.5 wt % of hydroxymethyl propyl cellulose were mixed, industrial alcohol was used as a solvent, after pelleting with a 20-mesh sieve, 2.5 wt % of magnesium stearate was added as a release agent, all the above materials were mixed uniformly and then passed through a 15-mesh sieve, and shaped into a ball shape by using processes including pelleting, mould pressing and extruding etc. and loaded to a fire extinguishing apparatus containing 50 g of a K-type hot aerosol generator, a 93# gasoline fire extinguishing test of an oil disk having an area of 0.25 $m^2$ was carried out; test results are as shown in Table 2 of test records.

Example 11

In the present example, 87 wt % of zinc acetate, 8 wt % of methacrylamide and 2.5 wt % of hydroxy methyl propyl cellulose were mixed, industrial alcohol was used as a solvent, after pelleting with a 20-mesh sieve, 2.5 wt % of magnesium stearate was added as a release agent, all the above materials were mixed uniformly and then passed through a 15-mesh sieve, and shaped into a ball shape by using processes including pelleting, mould pressing and extruding etc. and loaded to a fire extinguishing apparatus containing 50 g of a K-type hot aerosol generator, a 93# gasoline fire extinguishing test of an oil disk having an area of 0.25 $m^2$ was carried out; test results are as shown in Table 2 of test records.

Example 12

In the present example, 95 wt % of zinc acetate, and 2.5 wt % of hydroxy methyl propyl cellulose were mixed, industrial alcohol was used as a solvent, after pelleting with a 20-mesh sieve, 2.5 wt % of magnesium stearate was added as a release agent, all the above materials were mixed uniformly and then passed through a 15-mesh sieve, and shaped into a ball shape by using processes including pelleting, mould pressing and extruding etc. and loaded to a fire extinguishing apparatus containing 50 g of a K-type hot aerosol generator, a 93# gasoline fire extinguishing test of an oil disk having an area of 0.25 $m^2$ was carried out; test results are as shown in Table 2 of test records.

Example 13

In the present example, 60 wt % of manganese acetate, 35 wt % of cupric acetate and 2.5 wt % of hydroxymethyl propyl cellulose were mixed, industrial alcohol was used as a solvent, after pelleting with a 20-mesh sieve, 2.5 wt % of magnesium stearate was added as a release agent, all the above materials were mixed uniformly and then passed through a 15-mesh sieve, and shaped into a ball shape by using processes including pelleting, mould pressing and extruding etc. and loaded to a fire extinguishing apparatus containing 50 g of a K-type hot aerosol generator, a 93# gasoline fire extinguishing test of an oil disk having an area of 0.25 $m^2$ was carried out; test results are as shown in Table 2 of test records.

Example 14

In the present example, 94.7 wt % of manganese acetate, and 5.3 wt % of methacrylamide were mixed, industrial alcohol was used as a solvent, after pelleting with a 20-mesh sieve, 2.5 wt % of magnesium stearate was added as a release agent, all the above materials were mixed uniformly and then passed through a 15-mesh sieve, and shaped into a ball shape by using processes including pelleting, mould pressing and extruding etc. and loaded to a fire extinguishing apparatus containing 50 g of a K-type hot aerosol generator, a 93# gasoline fire extinguishing test of an oil disk having an area of 0.25 $m^2$ was carried out; test results are as shown in Table 2 of test records.

Comparison Experiment 2

A 93# gasoline fire extinguishing test was performed on an oil disk having an area of 0.25 $m^2$ for a fire extinguishing apparatus sample containing 100 g of a commercially available K-type hot aerosol fire extinguishing agent, and test results are as shown in Table 2.

What is claimed is:

1. A fire extinguishing composition containing a transition metal salt of an organic acid and a pyrotechnic agent;

and the fire extinguishing composition adopts the pyrotechnic agent as a heat source and a power source, reacts and releases a fire extinguishing material through heat emitted by igniting and burning the pyrotechnic agent, the mass percentage of the transition metal salt of the organic acid is 65 wt % to 95 wt %, the fire extinguishing composition further includes an auxiliary fire extinguishing agent in a mass percentage of 5 wt % to 35 wt %, the auxiliary fire extinguishing agent is an amine and/or organic amine salt;

wherein the transition metal salt of the organic acid is a ferric salt of an organic acid, a manganese salt of an organic acid, a nickel salt of an organic acid, a copper salt of an organic acid, a zinc salt of an organic acid or a cobalt salt of an organic acid;

wherein the ferric salt of the organic acid is one or more of ferric citrate, ferric oleate, ferric linoleate, ferric stearate, ferric benzoate, ferric acetate, ferric salicylate and ferric gluconate;

wherein the manganese salt of the organic acid is one or more of manganous acetate, manganous benzoate, manganese salicylate and manganese gluconate;

wherein the nickel salt of the organic acid is one or more of nickel oleate, nickel benzoate, and nickel salicylate;

TABLE 2

Test records of fire extinguishing compositions containing a salt of an organic acid of elements of a subgroup

| | Ingredient content of examples (mass percentage) | | | | | | | | Comparison |
|---|---|---|---|---|---|---|---|---|---|
| Ingredient | 7 | 8 | 9 | 10 | 11 | 12 | 13 | 14 | 2 |
| K type agent | • | • | • | • | • | • | • | • | • |
| Manganese acetate | 90 | 95 | | | | | 60 | 94.7 | |
| Copper acetate | | | | | | | 35 | | |
| Copper tartrate | | | 78 | 95 | | | | | |
| Zinc acetate | | | | | 87 | 95 | | | |
| Methacrylamide | 5 | | | | 8 | | | 5.3 | |
| N,N'-methylene-bisacrylamide | | | 17 | | | | | | |
| Hydroxy methyl propyl cellulose | 2.5 | 2.5 | 2.5 | 2.5 | 2.5 | 2.5 | 2.5 | 2.5 | |
| Magnesium stearate | 2.5 | 2.5 | 2.5 | 2.5 | 2.5 | 2.5 | 2.5 | 2.5 | |
| Fire extinguishing time(s) | 4.0 | 4.0 | 5.0 | 5.0 | 5.0 | 6.0 | 5.0 | 5.0 | |
| Fire extinguishing situation | All extinguished | All extinguished | All extinguished | 2 extiguished in 3 | All extinguished | All extinguished | All extinguished | All extinguished | Not extinguished |

It can be clearly seen from Table 2 that the fire extinguishing compositions containing an organic salt of transition metals in the group IB, the group IIB, and the group VIIB can completely meet basic fire extinguishing requirements of national standard GA86-2009 and there are no naked flames at all nozzles; the fire extinguishing performance is obviously better than that of the second comparison example and the fire extinguishing time is short. The fire extinguishing compositions containing an organic salt compound of transition metals in the group IB, the group IIB, and the group VIIB can meet ideal fire extinguishing requirements without addition of an auxiliary fire extinguishing ingredient in a certain mass percentage. However, by comprehensively considering aspects including spraying time, fire extinguishing time, the size of nozzle gas flows, spraying stability and processing etc.; a certain amount of an auxiliary fire extinguishing ingredient is added optimally.

wherein the copper salt of the organic acid is one or more of copper formate, copper oleate, copper linoleate, copper stearate, copper tartrate, copper 2-hydroxybutanedioate, copper iso-octoate, copper benzoate, and copper salicylate;

wherein the zinc salt of the organic acid is one or more of zinc oleate, zinc citrate, zinc benzoate, zinc methacrylate, zinc salicylate and zinc gluconate;

wherein the cobalt salt of the organic acid is one or more of cobalt acetate, cobalt citrate, cobalt iso-octoate, cobalt benzoate, and cobalt salicylate;

wherein the organic amine salt includes an organic amine hydrochloride and an organic amine sulphate;

wherein the organic amine salt is one or more of 2-methylaniline hydrochloride, 3,3'-dimethylbenzidine dihydrochloride, N'N-dimethyl-p-phenylenediamine sulphate, N,N'-dimethyl-p-phenylenediamine monohydrochloride, N'N-diethyl-p-phenylenediamine sulphate, N,N'-diethyl-p-phenylenediamine monohydrochloride, 1-naphthylamine hydrochloride, aniline hydrochloride, 3-hydroxyphenylamine hydrochloride, diphenylamine hydrochloride, dimethylamine hydrochloride, diethylamine hydrochloride, cyclohexylamine hydrochloride, benzidine sulfate, benzidine phydrochloride, trimethylamine hydrochlorate, ethylenediamine hydrochloride, m-phenylenediamine hydrochloride, o-phenylendiamine hydrochloride, o-bromoaniline hydrochloride, N(1-naphthyl)ethylenediamine hydrochloride and triethanolamine hydrochloride.

2. The fire extinguishing composition containing a transition metal compound according to claim 1, wherein the organic amine sulfate is one or more of m-phenylenediamine sulfate, hydroxylamine sulfate, o-phenylenediamine sulfate, 3-hydroxyphenylamine sulfate, ethylenediamine sulfate and diethylamine sulfate.

3. The fire extinguishing composition containing a transition metal compound according to claim 1, wherein the amine is one or more of o-nitroaniline, methacrylamide, salicylanilide, p-toluenesulfonamide, p-phenetidine, N-hydroxymethylbenzene sulfonamide, phthalimide and N,N'-methylenebisacrylamide.

4. The fire extinguishing composition containing a transition metal compound according to claim 1, wherein the fire extinguishing composition further includes a performance additive; the performance additive is hydroxy propyl methyl cellulose, talc or a combination thereof; the mass percentage of the performance additive ranging from larger than 0 to smaller than or equal to 15%.

5. The fire extinguishing composition containing a transition metal compound according to claim 4, wherein ingredients and mass percentage thereof in the fire extinguishing composition are as follows:

the salt of the organic acid of the fourth period transition metals: 75 wt % to 90 wt %;

auxiliary fire extinguishing agent: 5 wt % to 20 wt %;

performance additive: 5 wt %.

* * * * *